US009738490B2

(12) United States Patent
Penn et al.

(10) Patent No.: US 9,738,490 B2
(45) Date of Patent: Aug. 22, 2017

(54) CONTROL SYSTEM FOR A PLATFORM LIFT APPARATUS

(71) Applicant: SPACELIFT PRODUCTS, INC., Redondo Beach, CA (US)

(72) Inventors: Jay P. Penn, Redondo Beach, CA (US); Jeffrey Neil Cronin, Fairfield, CT (US)

(73) Assignee: Spacelift Products, Inc., Redondo Beach, CA (US)

( * ) Notice: Subject to any disclaimer, the term of this patent is extended or adjusted under 35 U.S.C. 154(b) by 191 days.

(21) Appl. No.: 14/756,109

(22) Filed: Aug. 3, 2015

(65) Prior Publication Data

US 2017/0036886 A1 Feb. 9, 2017

(51) Int. Cl.
*B66B 1/34* (2006.01)
*B66B 9/00* (2006.01)

(52) U.S. Cl.
CPC ..... *B66B 1/3461* (2013.01); *B66B 9/00* (2013.01)

(58) Field of Classification Search
CPC ..... B66B 1/3461; B66B 9/00
USPC ..... 187/247, 391, 393, 396
See application file for complete search history.

(56) References Cited

U.S. PATENT DOCUMENTS 5,366,045 A * 11/1994 Liston ..... B66B 5/22 187/376
5,735,507 A * 4/1998 Sierra Escudero ..... B66C 15/02 254/391
7,806,237 B2 * 10/2010 Aulanko ..... B66B 11/08 187/264
7,926,622 B2 * 4/2011 Henneau ..... B66B 5/00 187/393

(Continued)

*Primary Examiner* — David Warren
(74) *Attorney, Agent, or Firm* — O'Melveny & Myers LLP

(57) ABSTRACT

A platform lift apparatus moves objects vertically within a structure such as between floors of a residential or commercial structure. The platform lift apparatus further comprises a main body having a platform receiving portion and a utility portion. A drive train is substantially contained within the utility portion of the main body. The drive train comprises a rotatable shaft having plural lift drums and a motor operatively coupled to the shaft to cause selective rotation thereof. Each of the lift drums has an associated lift tether coupled thereto and wound thereon. A platform is coupled to respective ends of the lift tethers to suspend the platform from the platform receiving portion of the main body. The platform is selectively movable by operation of the drive train to travel vertically relative to the main body. The platform is substantially nested within the platform receiving portion of the main body when at an uppermost point of travel. At least one load sensor is operatively coupled to at least one of the lift tethers. The load sensor provides a load signal corresponding to load on the associated one of the lift tethers. A control circuit is operatively coupled to the motor and the at least (Continued)

one load sensor, wherein the control circuit controls operation of the motor responsive to the load signal. The control circuit causes the platform to travel upward by driving the motor to rotate the shaft in a first direction to wind the lift tethers onto the respective lift drums and causes the platform to travel downward by driving the motor to rotate the shaft in a second direction to unwind the lift tethers from the respective lift drums.

20 Claims, 10 Drawing Sheets

(56) References Cited

U.S. PATENT DOCUMENTS

| | | | | |
|---|---|---|---|---|
| 8,210,319 | B2 * | 7/2012 | Boyd | B66B 9/04 187/253 |
| 8,381,879 | B2 * | 2/2013 | Griffin | B66B 9/00 187/261 |
| 8,602,173 | B2 * | 12/2013 | Berner | B66B 5/125 187/250 |
| 8,857,571 | B2 * | 10/2014 | Henneau | B66B 5/12 187/393 |
| 8,869,946 | B2 * | 10/2014 | Okada | B66B 5/18 187/350 |
| 9,027,714 | B2 * | 5/2015 | Husmann | B66B 5/18 187/373 |
| 2004/0074706 | A1 * | 4/2004 | Ramseier | B66C 15/02 188/65.1 |
| 2017/0036886 | A1 * | 2/2017 | Penn | B66B 1/30 |

* cited by examiner

CONTROL SYSTEM FOR A PLATFORM LIFT APPARATUS

CROSS-REFERENCE TO RELATED APPLICATION

This patent application is a continuation of U.S. patent application Ser. No. 13/298,151, filed Nov. 16, 2011, now issued as U.S. Pat. No. 9,120,645 on Sep. 1, 2015.

BACKGROUND OF THE INVENTION

1. Field of the Invention

The present invention relates to residential or commercial storage, or more particularly, to a platform lift apparatus for raising or lowering objects into an upper storage location such as an attic storage space located above a garage or living quarters, between floors in a multi-story dwelling, or from a ground floor to a basement location, in which the apparatus actively controls the vertical movement of the platform to provide stable and safe operation.

2. Description of Related Art

It is often necessary to move objects between two adjacent floors of a building or residential structure. Because most homes lack an elevator or other automated contrivance to carry objects between floors, such tasks are usually performed manually by physically carrying the objects up or down flights of stairs. Not only are these tasks physically demanding, they are also a regular cause of injuries or damage to the objects being carried.

For example, many homes have attic spaces above garages and living quarters, and these attic spaces often provide a storage location for various items. While some attic spaces are finished and have access via a stairwell, most attic spaces remain unfinished and have more rudimentary access systems. The most basic access system is a simple opening or scuttle hole formed in the ceiling dividing the attic space from the room below. The scuttle hole is commonly located in a closet or main hallway, and may include a bottom cover or hatch that comprises a removable portion of ceiling, such as formed from plywood or drywall. A user would position a ladder below the opening and access the storage space by carrying storage objects up and down the ladder. An improvement over this basic access system is a pull-down ladder that is built into a hingedly attached door covering the opening. The pull-down ladder may include a plurality of sections that may be folded together to provide a compact structure when stowed. The user opens the door and unfolds the ladder to bring it into an operational position. This pull-down ladder has improved convenience since the user does not have to transport a ladder to and from the access location, and the ladder is anchored to the opening to thereby provide stability to the ladder and an increased degree of safety for the user.

Nevertheless, a drawback of each of these access systems is that it is difficult to transport objects up and down the ladder. The user cannot easily carry the object and grasp the ladder at the same time, thereby forcing a dangerous tradeoff between carrying capacity and safety. Moreover, the size and weight of the objects that may be transported is limited to that which could be manually carried and fit through the dimensions of the access opening. Users of such access systems have a substantial risk of injury due to falling and/or dropping objects, and the objects themselves can be damaged as well.

Thus, it would be advantageous to provide an improved way to transport objects to and from an attic or basement storage space, or between floors of a structure, without the drawbacks and safety risks of the known access systems.

SUMMARY OF THE INVENTION

The present invention overcomes the foregoing drawbacks of the prior art by providing a platform lift apparatus usable to safely move objects vertically between floors of a commercial or residential structure.

The platform lift apparatus further comprises a main body having a platform receiving portion and a utility portion. A drive train is substantially contained within the utility portion of the main body. The drive train comprises a rotatable shaft having plural lift drums and a motor operatively coupled to the shaft to cause selective rotation thereof. Each of the lift drums has an associated lift tether coupled thereto and wound thereon. A platform is coupled to respective ends of the lift tethers to suspend the platform from the platform receiving portion of the main body. The platform is selectively movable by operation of the drive train to travel vertically relative to the main body. The platform is substantially nested within the platform receiving portion of the main body when at an uppermost point of travel.

At least one load sensor is operatively coupled to at least one of the lift tethers. The load sensor provides a load signal corresponding to load on the associated one of the lift tethers. A control circuit is operatively coupled to the motor and the at least one load sensor, wherein the control circuit controls operation of the motor responsive to the load signal. The control circuit causes the platform to travel upward by driving the motor to rotate the shaft in a first direction to wind the lift tethers onto the respective lift drums and causes the platform to travel downward by driving the motor to rotate the shaft in a second direction to unwind the lift tethers from the respective lift drums.

In an embodiment of the invention, the shaft further carries a first pair of the lift drums at a first end thereof and a second pair of the lift drums at a second end thereof. The platform lift apparatus further includes plural pulleys arranged around the platform receiving portion to guide respective ones of the lift tethers from respective ones of the lift drums to the platform.

In another embodiment of the invention, a position encoder is operatively coupled to the motor. The position encoder provides a position signal to the control circuit corresponding to a rotational position of the shaft. The position encoder may be directly coupled to the motor or may be directly coupled to the shaft. The control circuit derives a vertical position of the platform from the position signal. More particularly, the control circuit compares the vertical position to a predetermined floor setting and stops downward movement of the platform when the vertical position corresponds to the predetermined floor setting. In a similar manner, the control circuit stops upward movement of the platform when a predetermined position is reached, such as the stow position for the platform. The control circuit may also compare the load signal to a predetermined maximum load setting and takes corrective action if the load signal exceeds the predetermined maximum load setting. The corrective action may include stopping vertical movement of the platform, reversing direction of the motor, and/or issuing an audible or a visual warning to a user.

In another embodiment of the invention, the platform lift apparatus further comprises at least one guide roller coupled to the platform receiving portion of the main unit to guide vertical movement of the platform.

In another embodiment of the invention, the platform lift apparatus further comprises at least one locking actuator coupled to the platform receiving portion of the main unit. The locking actuator has a locking pin that is moveable between retracted and extended positions. The locking pin selectively locks the platform in the uppermost position when in the extended position. The locking actuator is responsive to the control circuit. More particularly, the control circuit drives the motor to cause the platform to move upward to the uppermost position, whereupon the control circuit causes the locking actuator to move the locking pin from the retracted to the extended position, and then reverses direction of the motor to cause the platform to rest on the locking pin.

In another embodiment of the invention, the platform lift apparatus further comprising a platform position sensor coupled to the platform receiving portion. The platform position sensor provides a platform position signal to the control circuit indicating that the platform has reached the uppermost position.

In another embodiment of the invention, the platform lift apparatus further comprises at least one remote control unit operatively coupled to the control circuit. Each remote control unit receives user commands to change vertical position of the platform.

A more complete understanding of the platform lift system will be afforded to those skilled in the art, as well as a realization of additional advantages and objects thereof, by a consideration of the following detailed description of the preferred embodiment. Reference will be made to the appended sheets of drawings, which will first be described briefly.

DETAILED DESCRIPTION OF PREFERRED EMBODIMENTS OF THE INVENTION

The present invention satisfies the need for an improved way to transport objects between floors of a commercial or residential structure without the drawbacks and safety risks of the known access systems. In the detailed description that follows, like element numerals are used to describe like elements illustrated in one or more figures.

More particularly, the invention provides a platform lift system that enables objects to be moved vertically between an attic space and a room below, between floors, or from floor to basement. The platform lift system includes a frame that is mounted into a scuttle hole formed in a horizontal supporting surface (i.e., attic floor or room ceiling) and a platform that is supported by the frame. The platform may be selectively raised or lowered in order to transport objects to/from the basement, room or attic space. When in a raised position, the platform engages the frame and seals the space above to provide a thermal barrier. Objects may be loaded onto or removed from the platform through the frame from within the room or attic space. The frame may be installed so that it lies substantially flush with the ceiling floor, so as to maximize available space within the upper room and minimize interference between the lift system and objects moved on and off the platform. Alternatively, the frame may be installed slightly below the ceiling floor with a hatch installed above the frame. When closed, the hatch is flush with the floor and provides a surface that can be walked upon. Then, when it is desired to use the platform lift system, the hatch is opened (either manually or automatically) to expose the platform lift system.

The frame further includes a drive system that controls the movement of a plurality of tethers that are coupled to the platform. The platform is raised by withdrawing the tethers, and is lowered by paying out the tethers. A plurality of load sensors continuously detect the load placed upon each of the tethers, and this load information is communicated to a central control system. If the load suddenly changes, such as indicating that the platform has come into contact with an obstacle, the control system can stop the movement of the platform to enable the user to clear the obstacle out of the way.

It should be understood that the present patent application uses the term "attic" to broadly refer to a room or space disposed above a garage or living quarters of a residential or commercial structure. While in most cases the attic comprises an uppermost space of the house located immediately below a roof, it should be appreciated that other raised spaces of a house, such as a loft, crawlspace, deck, balcony or patio, could also fall within a broad meaning of an attic as used in the present patent application.

Figure 1:
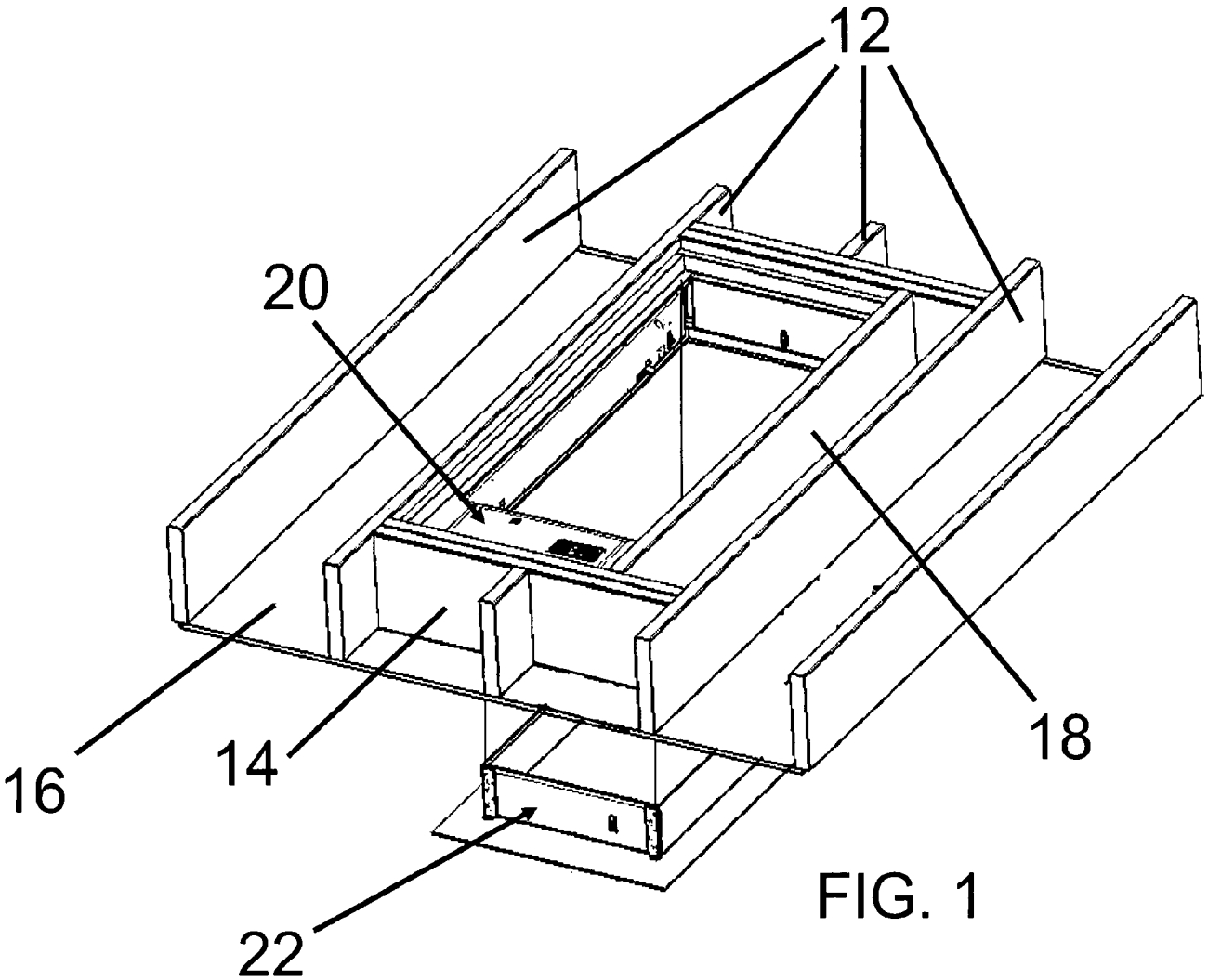
FIG. 1 is a partial sectional perspective view of a platform lift system installed between joists of an attic space in accordance with an embodiment of the invention.

Referring first to FIG. 1, a perspective view of an embodiment of the platform lift system is shown. The platform lift system includes a main unit 20 and a moveable platform 22. The main unit 20 has a generally rectangular shape that permits installation within a floor structure that separates adjacent levels of a residential or commercial structure. The floor structure shown in FIG. 1 includes a ceiling 16 (such as made of plywood or drywall) supported by a plurality of joists 12. The spacing between adjacent joists is typically defined by local building codes. The upper surface of the main unit 20 would be oriented within the floor structure so that it does not protrude above the tops of the joists 12. This way, a floor (such as using plywood) can be provided on top of the joists 12. By orienting the main unit 20 below the surface of the floor, the platform lift system can be covered by a hatch or moveable door when not in use. Similarly, the lower surface of the main unit 20 would be oriented above the ceiling 16 of the level below. Thus, in accordance with the embodiment of FIG. 1, the main unit 20 is contained entirely within the floor structure. In the following description, the space below the floor structure shown in FIG. 1 is referred to as the first level, and the space above the floor structure shown in FIG. 1 is referred to as the second level.

The main unit 20 fits within a rectangular scuttle hole formed within the ceiling structure. The scuttle hole is bounded on two opposite sides by joists 12 and on the other opposite sides by crosspieces 14. It should be appreciated that the size of the scuttle hole would be selected to permit the platform lift system to be in substantial contact with the sides of the scuttle hole formed by the joists 12 and crosspieces 14. In order to frame the scuttle hole, a section of an intermediary joist 12 is removed for the length of the scuttle hole, such that the width of the scuttle hole corresponds to roughly twice the separation between adjacent joists plus the width of one joist. Depending upon the spacing between adjacent joists, it may be necessary or desirable to include an additional header 18 in the long dimension parallel to the joists 12 and extending between crosspieces 14. Suitable brackets may be added to the corners formed by the intersecting joists 12 and crosspieces 14 to provide a rigid structural connection between the main unit 20 and to insure the integrity of the floor structure. In some applications, and depending upon the requirements of local building codes, it may also be desirable to include insulating materials, such as foam, in the space formed between the sides of the main unit 20 and the sides of the scuttle hole in order to provide a thermal barrier between floors of the structure.

The platform (or tray) 22 is suspended from the main unit 20 by a plurality of tethers (described below). The platform 22 is selectively moveable between a stowed position in which the platform nests within the main unit 20, and a deployed position in which the platform hangs vertically below the main unit. By controlling the movement of the platform 22, an operator can selectively move objects between the first and second levels of a commercial or residential structure.

Figure 2:
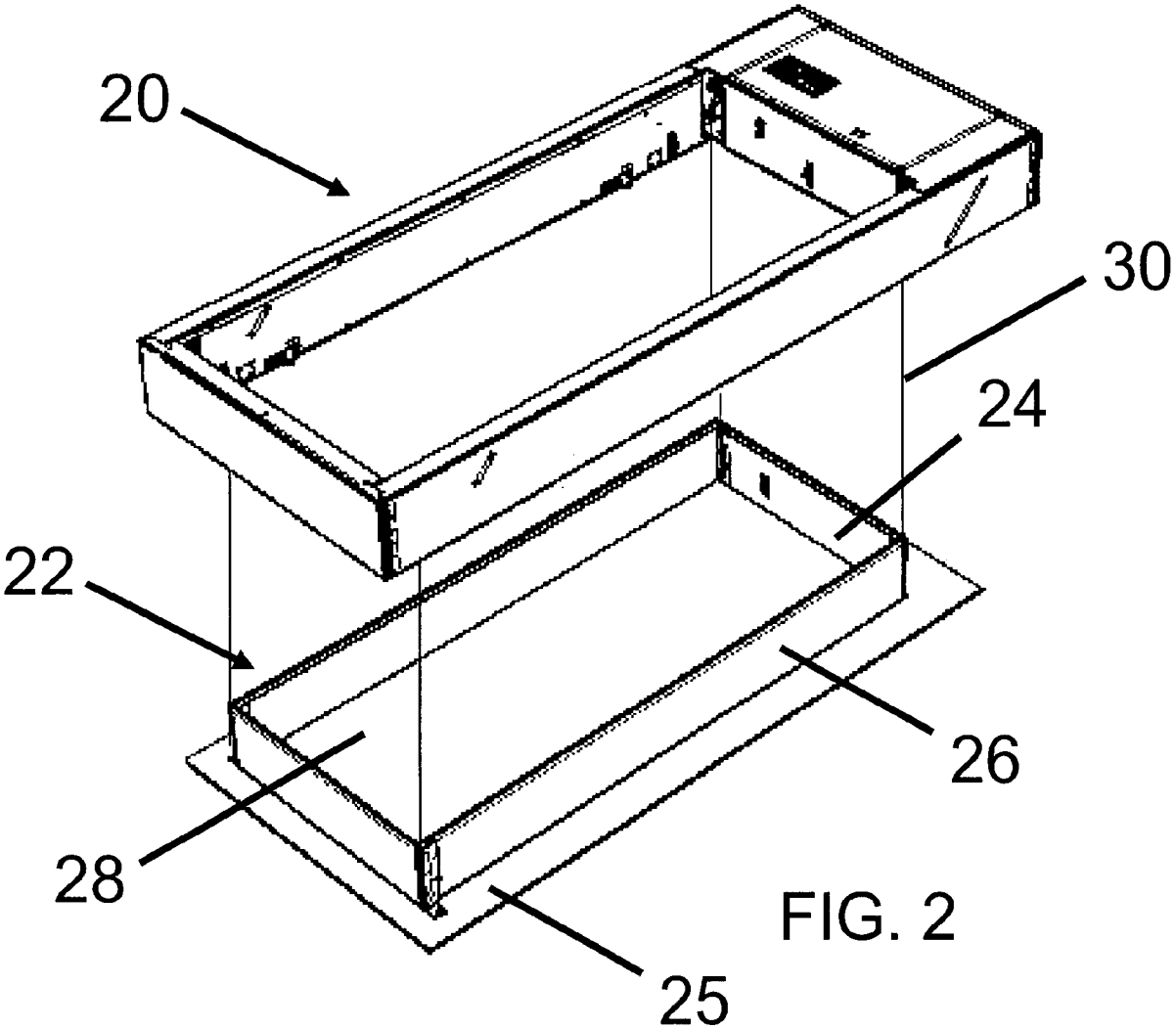
FIG. 2 is a perspective view of the platform lift system shown in FIG. 1 showing a deployed platform.

FIG. 2 shows the main unit 20 and platform 22 in perspective view isolated from the floor structure. The main unit 20 comprises a generally rectangular structure having enclosed outer sides. As illustrated in FIG. 2, the main unit 20 includes a platform receiving portion (shown generally to the left) having a rectangular opening to permit the platform 22 to nest therein when stowed, and a utility portion (shown generally to the right) that provides a compartment for a drive and control system (described below). The platform 22 is suspended from the platform receiving portion of the main unit 20 by four tethers 30. In a preferred embodiment of the invention, the tethers 30 are provided by steel cables, although other suitable materials could also be advantageously utilized.

The rectangular platform 22 is formed from upright walls 24, 26 and base 28. The upright walls 24 are disposed on the short dimension of the rectangular platform 22 and the upright walls 26 are disposed on the long dimension of the platform. It should be appreciated that other shapes for the platform, such as square, could also be advantageously utilized. An optional ceiling cover 25 is attached below the platform. When utilized, the ceiling cover 25 is intended to engage flush with the ceiling upon stowing of the platform 22 within the main unit 20. The ceiling cover 25 serves to conceal the platform lift system from view when stowed and additionally provides a thermal barrier between the first and second levels of the residential or commercial structure. The ceiling cover 25 may be comprised of suitable materials, such as plywood or wallboard, to match the materials of the ceiling of the first level. Optionally, thermal insulating materials may be attached to the ceiling cover, such as sandwiched between the ceiling cover and the bottom of the platform, in order to enhance the thermal separation between levels of the structure and prevent heat loss through the scuttle hole.

Figure 3:
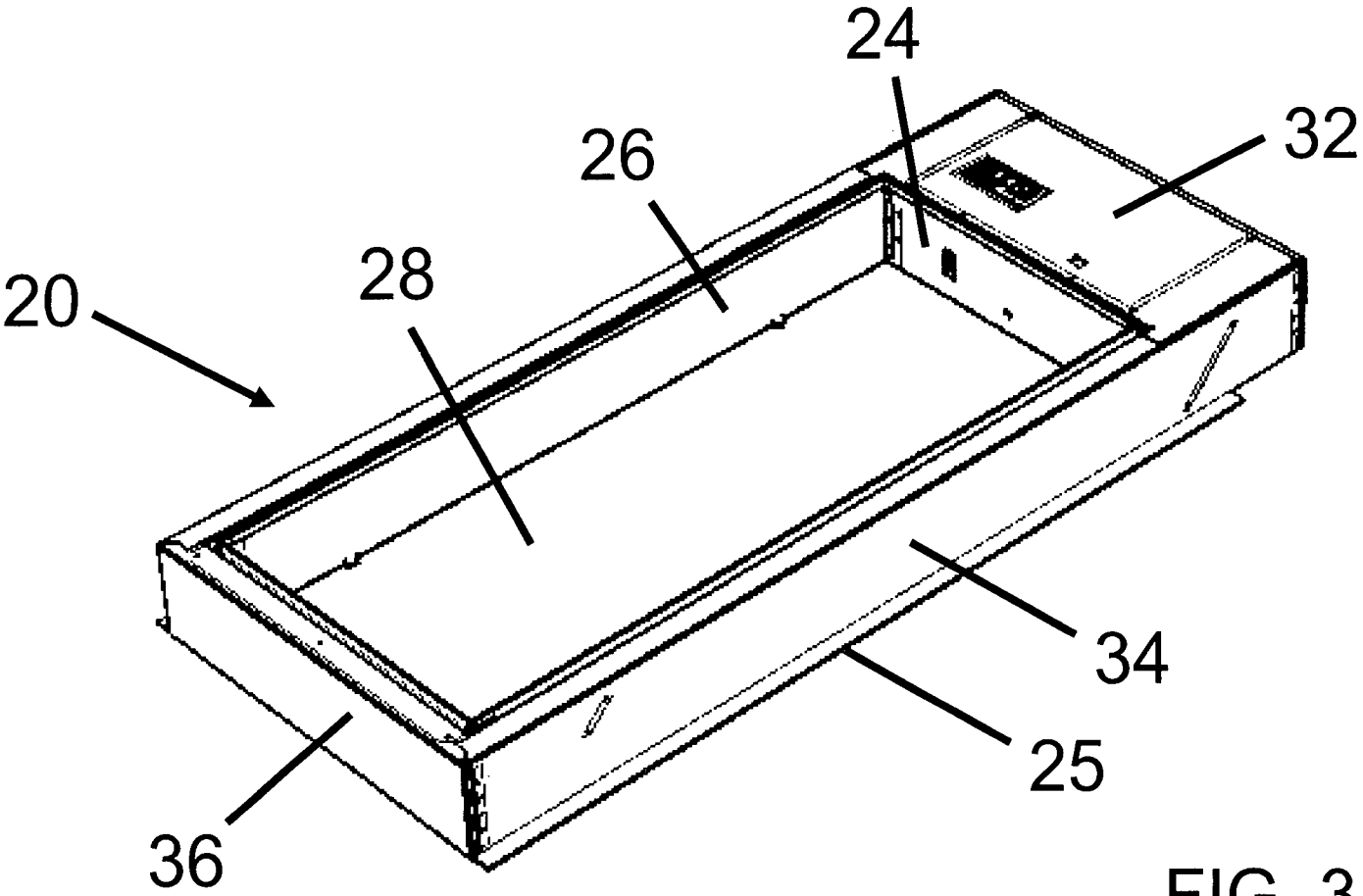
FIG. 3 is a perspective view of the platform lift system shown in FIG. 1 showing a stowed platform.
Figure 4:
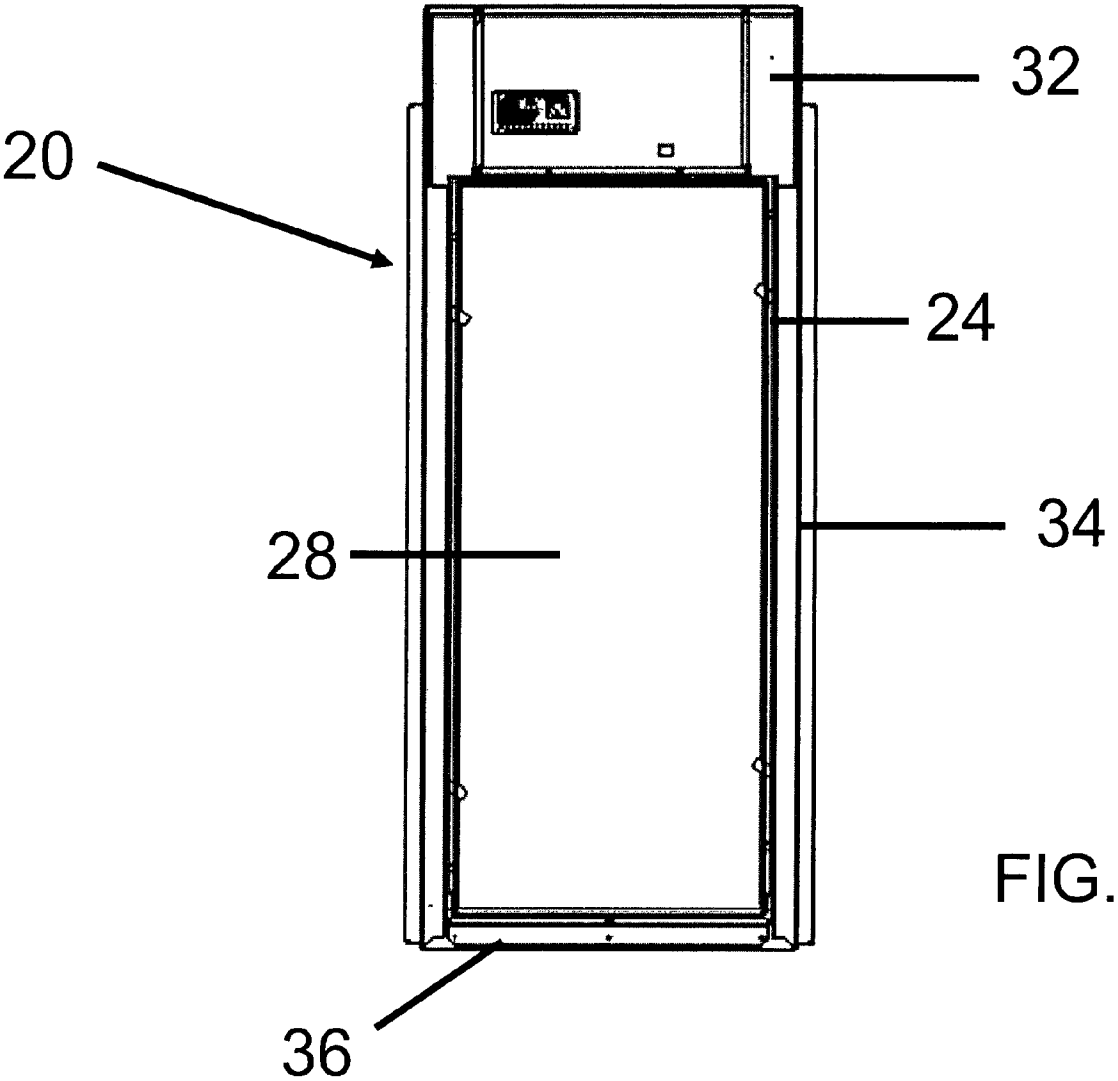
FIG. 4 is a top view of the platform lift system of FIG. 1.

FIG. 3 shows the platform 22 nested within the platform receiving portion of the main unit 20 when in the stowed position. As illustrated in FIG. 3, the walls 24, 26 of the platform are closely aligned with the corresponding interior walls of the opening in the main unit. When stowed, the tops of the walls 24, 26 are substantially aligned with the top surface of the main unit 20. FIG. 3 further illustrates outer side surfaces 34, 36 of the main unit 20. As discussed above with respect to FIG. 1, the outer side surfaces 34, 36 nest within and engage the sides of the scuttle hole formed in the floor structure. FIG. 3 further illustrates a top cover 32 of the main unit 20. The top cover 32 is removable to permit access to the drive and control systems of the platform lift system located at one end of the main unit 20. FIG. 4 shows a top view of the main unit 20, including the outer side surfaces 34, 36 and the top cover 32, along with the walls 24 and floor 28 of the platform.

Figure 5:
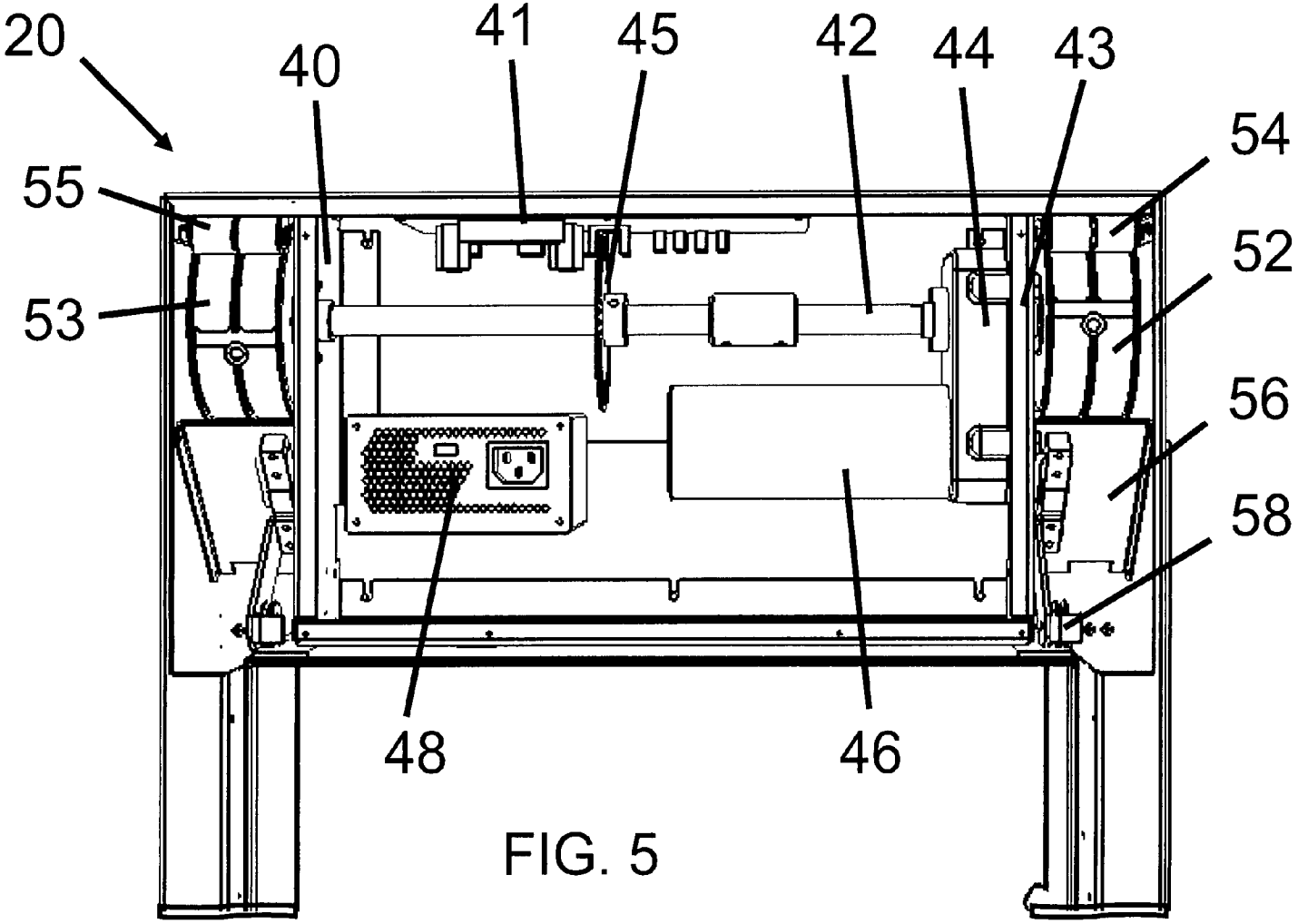
FIG. 5 is a partial top view of the platform lift system showing the cover removed to expose the drive and load management systems.

In FIG. 5, the top cover 32 is removed from the platform lift system to expose the drive and control system. The interior of the main unit 20 is divided into three sections by vertical walls 40 and 43. A central section of the interior provides a main compartment that houses the electrical and mechanical components used to drive the platform lift system. A drive shaft 42 extends horizontally through the interior space and passes through openings (not shown) formed in the vertical walls 40, 43. One or more bearings may be provided to promote smooth rotation of the drive shaft 42. A first end of the drive shaft 42 is coupled to right side spool 52, and a second end of the drive shaft is coupled to left side spool 53. The two spools 52, 53 each carry a supply of tether material wound thereon, such that the platform 22 is raised by winding up the tether material and the platform is lowered by paying out the tether material. Each of the spools 52, 53 is further divided into left and right-hand sections to enable carrying of two separate lengths of tether material onto each roller, e.g., a proximal and a distal tether. It is preferred that there be four tethers, with one tether attached to each respective corner of the platform 22. It should be appreciated, however, that a greater or lesser number of tethers could be used depending upon the dimensions, application, and load demands of the platform lift system.

In a preferred embodiment of the invention, the tether materials are formed of steel cables. To accommodate the winding and paying out of the cables from the spools 52, 53, the spools may be further provided with grooves that wrap around their outer surfaces in a spiraling fashion. Rollers 54, 55 may also be arranged to press against the outer surfaces of the spools 52, 53 to further promote even winding of the tether materials onto the spools and to prevent any undesired unspooling of the tether material. The rollers 54, 55 may be spring loaded to apply pressure against the spools 52, 53, respectively.

Adjacent to the right side spool 52 is an associated load sensor bracket 56 and load sensor lever arm 58. A roller is located at an end of the load sensor lever arm to guide movement of the tether coupled to the left side spool 52. A similar load sensor bracket and load sensor lever arm is located adjacent to the left side spool 53. As described in further detail below, the load sensor bracket 56 carries a load sensor that is operatively coupled to the load sensor lever arm. The load sensor generates an electrical signal that corresponds to the force applied by the tether onto the load sensor lever arm. In a preferred embodiment, there is a corresponding load sensor associated with each one of the four tethers.

The drive shaft 42 is driven by a motor 46 and a gearbox 44. In a preferred embodiment, the motor 46 is a DC motor, although an AC motor could also be advantageously utilized. The gearbox 44 provides a reduction of the rotational rate of the motor 46, such as a 30:1 reduction. The gear reduction provides increased torque to the lifting capability of the platform lift system, and also provides sufficient back-tension to prevent undesirable downward movement of the platform when the motor 46 is turned off. The gearbox 44 may additionally be provided with a brake to actively prevent rotation of the drive shaft 42 when the motor 46 is stopped.

The platform lift system also includes electrical components that control the operation of the motor 46. A power supply 48 is located within the main compartment and provides a power source for the motor 46 and other electrical systems. A circuit board 41 provides control logic to control operation of the motor 46 in response to various feedback signals, including the electrical signal from the load sensors. In an embodiment of the invention, a disk 45 is attached to the drive shaft 42. The disk 45 includes a plurality of radially oriented openings. A corresponding sensor, such as a photocell, is included on the circuit board 41 and is physically arranged so that a peripheral portion of the disk 45 engages the sensor. As the disk 45 rotates in conjunction with the drive shaft 42, the radial openings of the disk pass through the sensor. When one of the openings is positioned within the sensor, light from the sensor passes through the opening, and the sensor produces an electrical signal having a pulse width that corresponds respectively to the time period when an opening passes the sensor. This way, the electrical signal provides feedback about the rotational movement of the drive shaft 42. For example, the frequency of the pulses corresponds to the rotational speed of the drive shaft 42. Also, by counting the pulses, the control system can keep track of the vertical position of the platform relative to the main unit.

In an alternative embodiment of the invention, a position sensor or encoder could be directly coupled to the motor 46 instead of the drive shaft 42. The position sensor/encoder could be optically based like the preceding embodiment or could derive a signal using other known means such as a Hall-effect sensor. Because the motor 46 has a shaft that turns a much faster rate than the drive shaft 42, an electrical signal corresponding to the rotation of the motor shaft would have a greater degree of precision and granularity for use in calculating the motor speed and rotational position.

Figure 6:
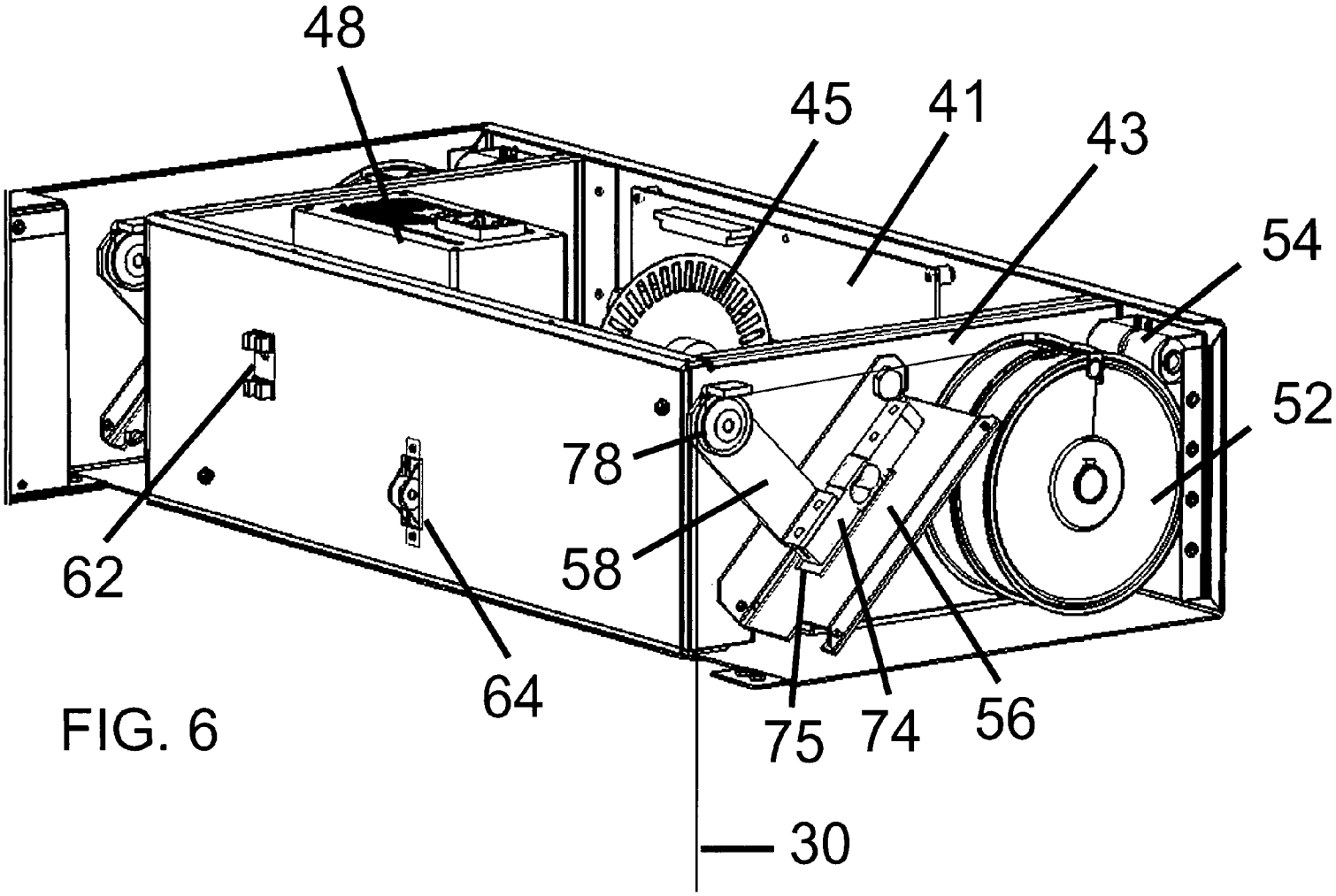
FIG. 6 is a perspective exploded view of the platform lift system showing the drive and load management systems.

FIG. 6 shows a perspective view of the portion of the platform lift system shown in FIG. 5. The perspective view shows the radial openings of the disk 45, and also shows the spool 52 and associated roller 54.

FIG. 6 also shows the load sensor bracket 56 with more detail of the load sensor. The load sensor bracket 56 is mounted to the wall 43 and provides a stable surface for the load sensor 74. The load sensor 74 may comprise a conventional bending beam load cell that is oriented in a cantilevered fashion over an opening 75 formed in the load sensor bracket 56. The opening 75 is aligned with the tether 30 so that forces applied to the tether cause the load sensor 74 to bend relative to the bracket 56. The load sensor 74 is oriented so that the force of the measured stress remains perpendicular to the mounting surface of bracket 56 while proceeding in alignment with the vertical plane of the longitudinal center line. In turn, the load sensor 74 produces an electrical signal that corresponds to the magnitude of the bending of the load sensor. An arm 58 is mounted to and extends from the load sensor. A roller 78 is coupled to an end of the arm 58 and provides a guide for the tether 30. As illustrated in FIG. 6, the tether 30 passes the roller 78 and is wound onto the spool 52. Accordingly, forces applied to the tether 30, such as produced by the weight of the platform 22 and objects carried therein, is reflected by the electrical signal produced by the load sensor 74. This way, the control system for the platform lift system can receive a real-time indication of the load carried by the platform 22. As will be further described below, a similar load sensor may be operatively associated with each tether used to carry the platform 22.

Also show in FIG. 6 is an exemplary guide roller 64 mounted to a side surface of an interior wall of the main unit 20. The guide roller 64 includes a wheel that is freely rotatable upon contact with the sidewalls of the platform 22. The guide roller 64 assists in controlling vertical movement of the platform 22 as it passes into or out of the stowed position. It should be appreciated that there may be other such guide rollers 64 located on the same or other interior walls of the main unit 20 as needed to provide smooth movement of the platform 22 relative to the main unit. The guide roller 64 may further be spring actuated to apply pressure onto the sidewalls of the platform 22 and thereby keep it roughly centered within the rectangular opening in the main unit 20 during stowing and unstowing operations.

FIG. 6 further shows an exemplary position sensor 62 mounted to a side surface of an interior wall of the main unit 20. The purpose of the position sensor 62 is to provide a signal indicating that the platform 22 has reached the top of its travel. In an embodiment of the invention, the position sensor 62 may comprise an embedded light emitting diode (LED) and photocell located on opposite sides of a vertically-oriented axial slot formed in the sensor. The photocell produces an electrical signal when it receives light from the LED. A flag (not shown) may be mounted to an exterior sidewall of the platform 22 and oriented so that it passes through the slot formed in the position sensor 62 and thereby cuts off light from passing from the LED to the photocell. Hence, the position sensor 62 can produce an electrical signal that indicates that the platform 22 has reached an uppermost position. It should be appreciated that many other types of position sensors, such as a magnetically actuated sensor or reed switch, could also be advantageous used to achieve the same purpose. Moreover, there may be plural such position sensors 62 disposed around the interior walls of the main unit 20 in order to provide further information concerning position and orientation of the platform 22.

Figure 7:
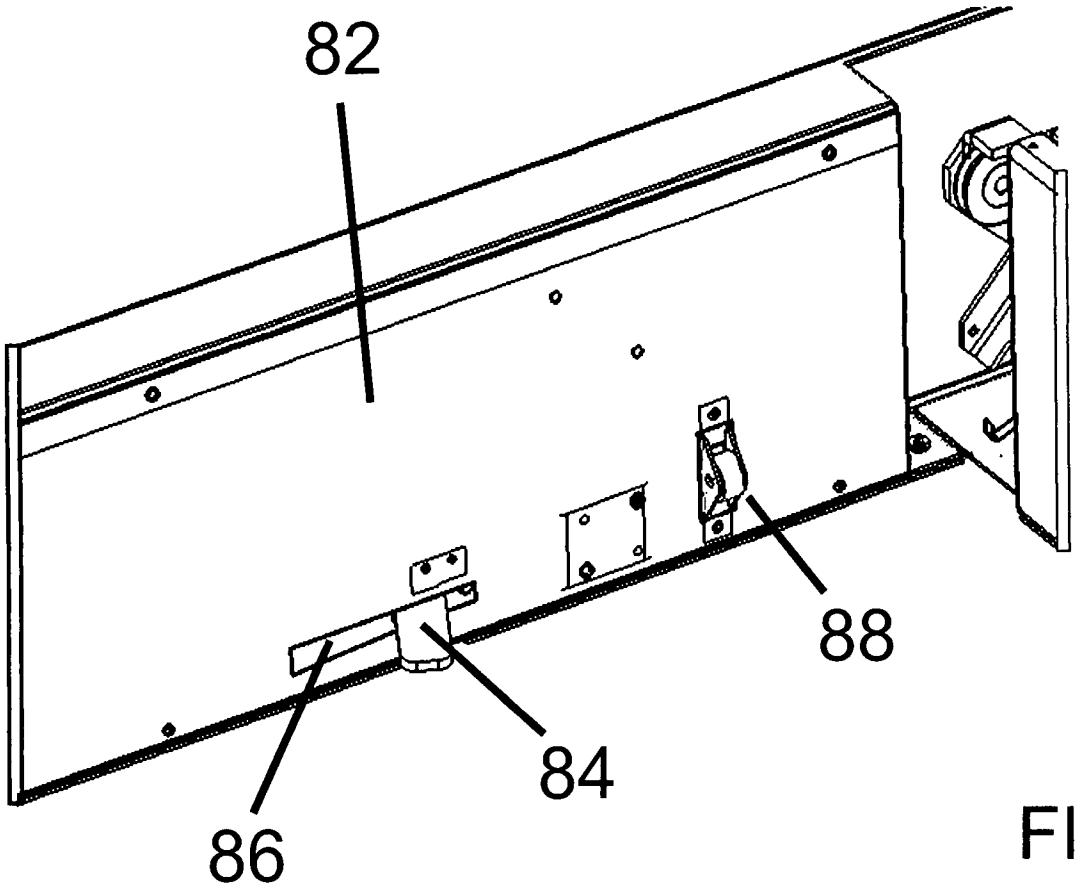
FIG. 7 illustrates an interior side of the platform lift system showing an exemplary locking mechanism extended for securing the platform in the stowed position.
Figure 8:
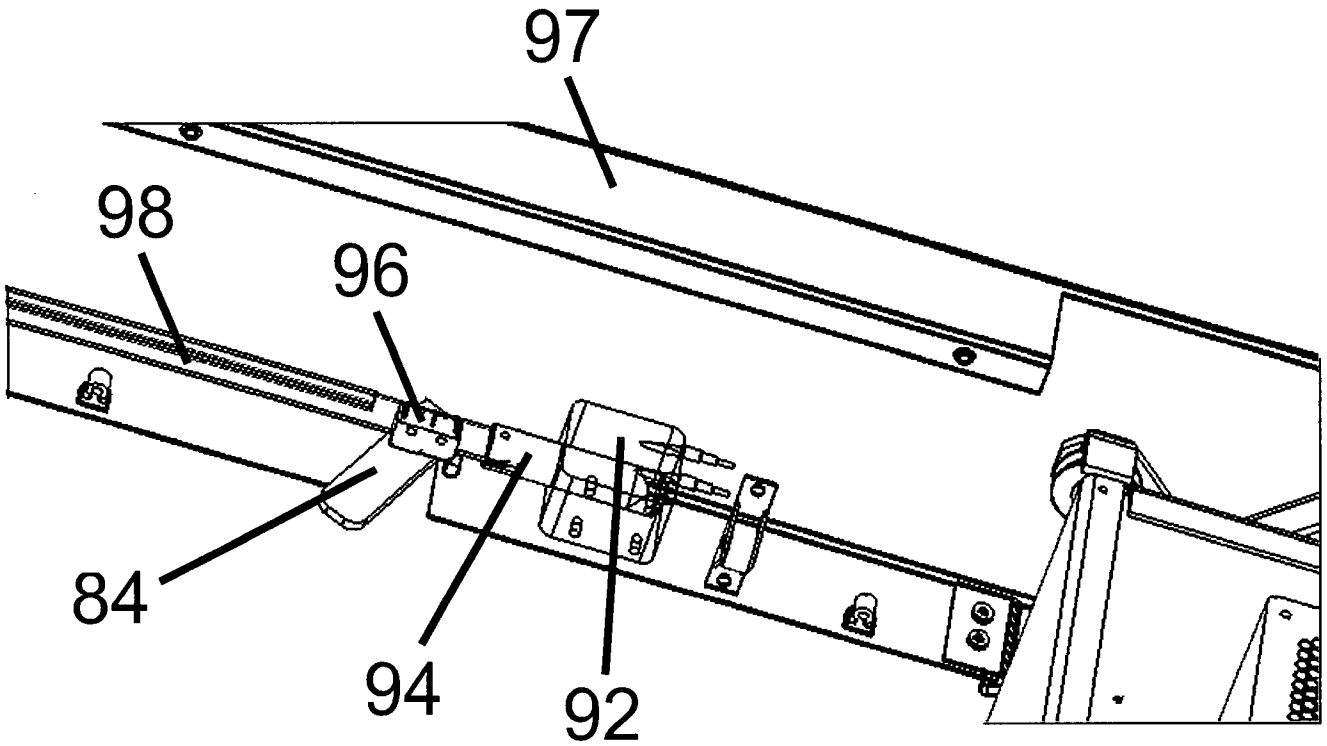
FIG. 8 illustrates an interior side of the platform lift system as in FIG. 7 with the cover removed to show an exemplary actuator used to drive the locking pin.

Another interior wall of the main unit 20 is shown in FIGS. 7 and 8. The interior wall of FIGS. 7 and 8 corresponds to one of the long-dimension walls surrounding the platform 22 when stowed. Like the interior wall shown in FIG. 6, the interior wall of FIGS. 7 and 8 also includes a guide roller 88. The guide roller 88 is constructed similarly to the guide roller 64 of FIG. 6. A function of the guide rollers 88 and 64 is to ensure that the platform 22 is properly oriented within the opening in the main unit 20 during stowing so as to insure proper operation of the position sensor 62. In particular, if the platform 22 is not centered within the opening in the main unit 20, the flag may not be aligned with the slot of the position sensor 62. As a result, the position sensor 62 might fail to provide a signal indicating that the platform 22 has reached an uppermost position.

The interior wall may further include a panel 82 that is removable to permits access for maintenance or repair purposes. FIG. 8 illustrates the same interior wall 97 as FIG. 7, with the panel 82 removed to expose a solenoid 92, armature 94, joint 96, and transfer arm 98. While FIGS. 7 and 8 show the left interior wall of the main unit 20 as viewed from above, it should be appreciated that the right interior wall would have similar construction.

FIGS. 7 and 8 additionally show a locking arm 84 that protrudes inwardly from the interior wall 97. The locking arm 84 is coupled to the armature 94 of solenoid 92 so that it swings laterally between a retracted position and an extended position. A joint 96 enables coupling between the armature 94 and the locking arm 84. The locking arm 84 is coupled to a pivot point formed by the joint 96 and the locking arm 84. The locking arm extends inwardly toward the platform 22 when the armature 94 is extended outwardly of the solenoid 92, and extends outwardly so that it nests within the interior wall when the armature 94 is extended inwardly of the solenoid 92. FIGS. 7 and 8 illustrate the locking arm 84 in the extended position.

The joint 96 is additionally coupled to the transfer arm 98. The transfer arm 98 extends parallel to the interior wall along its length to the opposite end of the main unit 20. The transfer arm 98 would then be connected to another joint and locking arm in a like manner as is shown in FIG. 8. This way, the same solenoid 92 can control the operation of two or more locking arms 84. In a preferred embodiment of the present invention, there would be a pair of transfer arms associated with each of the two interior walls of the main unit 20, though it should be understood that three or more locking arms 84 could be included on each side. The number of locking arms used would depend on the desired load carrying capability of the platform 22.

As shown in FIG. 7, a slot 86 may be formed in the panel 82 to provide a passage for the movement of the locking arm 84 such that the locking arm 84 travels inwardly and outwardly through the slot 86. The locking arm 84 has a relatively broad width and is constructed of a relatively rigid material, such as metal. The locking arm 84 is normally retracted into the interior wall during vertical movement of the platform 22. When the platform 22 has reached the uppermost position during a stowing operation, the bottom of the platform 22 would be positioned just above the locking arm 84. Then, the locking arm 84 is actuated to move from the retracted to the extended position (as shown in FIG. 7). After reaching the uppermost position, the platform 22 reverses direction and moves downward slowly until it comes to rest on top of the locking arm 84. In this stowed position, the weight of the platform 22 is supported on top of the locking arm 84. It should be appreciated that there would be plural such locking arms in order to evenly support the weight of the platform 22. The locking arms 84 prevent the platform 22 from inadvertently dropping from the stowed position, such as if additional weight is placed into the platform. Another purpose of the locking arms 84 is to remove mechanical stress from the load sensors when the apparatus is not in use. The load sensors may lose their accuracy if left with weight on them for long periods of time.

When it is desired to move the platform 22 from the stowed to the deployed position, the aforementioned process is reversed. First, the platform 22 is moved upward to the uppermost position to withdraw the weight of the platform from pressing onto the locking arms 84. Next, the locking arms 84 are actuated to move into the retracted position (inside the slot 86). Then, the platform 22 is moved downward past the retracted locking arms 84. The locking arms 84 would remain in the retracted position until the platform 22 again reaches the uppermost position.

It should be appreciated that a variety of known alternative structures could be used to restrict the motion of the platform 22 when it is in a stowed position. For example, a locking pin extending from the main unit 20 may be directly driven by a motor or other like means to extend under the platform 22 or into a hole or slot formed in the platform to thereby fix its position.

Figure 9:
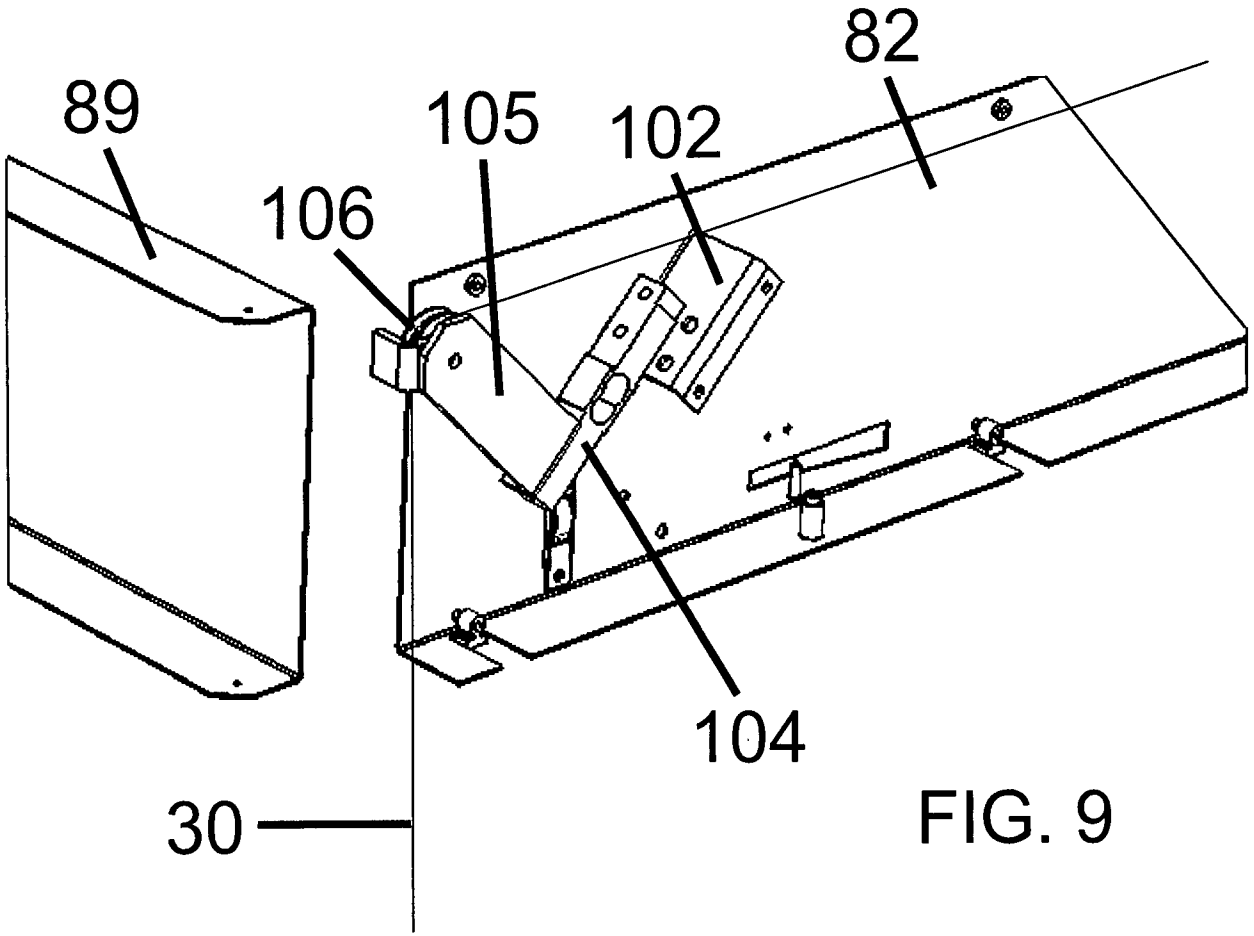
FIG. 9 illustrates an interior side of the platform lift system with the cover removed to show an exemplary load sensor.

FIG. 9 illustrates a corner of the main unit 20 distal from the previously described end having the compartment housing the drive and control mechanism. For ease of illustration, it should be appreciated that certain panels have been removed to expose the interior of the inner walls 82. A load sensor bracket 102 is mounted to the wall 82 and provides a stable surface for the load sensor 104. The load sensor 104 would have a construction just like the aforementioned load sensor 74. An arm 105 is mounted to and extends from the load sensor 104. A roller 106 is coupled to an end of the arm 105 and provides a guide for the tether 30. As illustrated in FIG. 9, the tether 30 passes the roller 106 and extends within the side wall to an associated spool (e.g., spool 52 of FIGS. 5 and 6). Accordingly, as described above, forces applied to the tether 30, such as produced by the weight of the platform 22 and objects carried therein, is reflected by the electrical signal produced by the load sensor 104. It should be appreciated that another similar load sensor and arm would be included at the other corner of the main unit 20.

Figure 10:
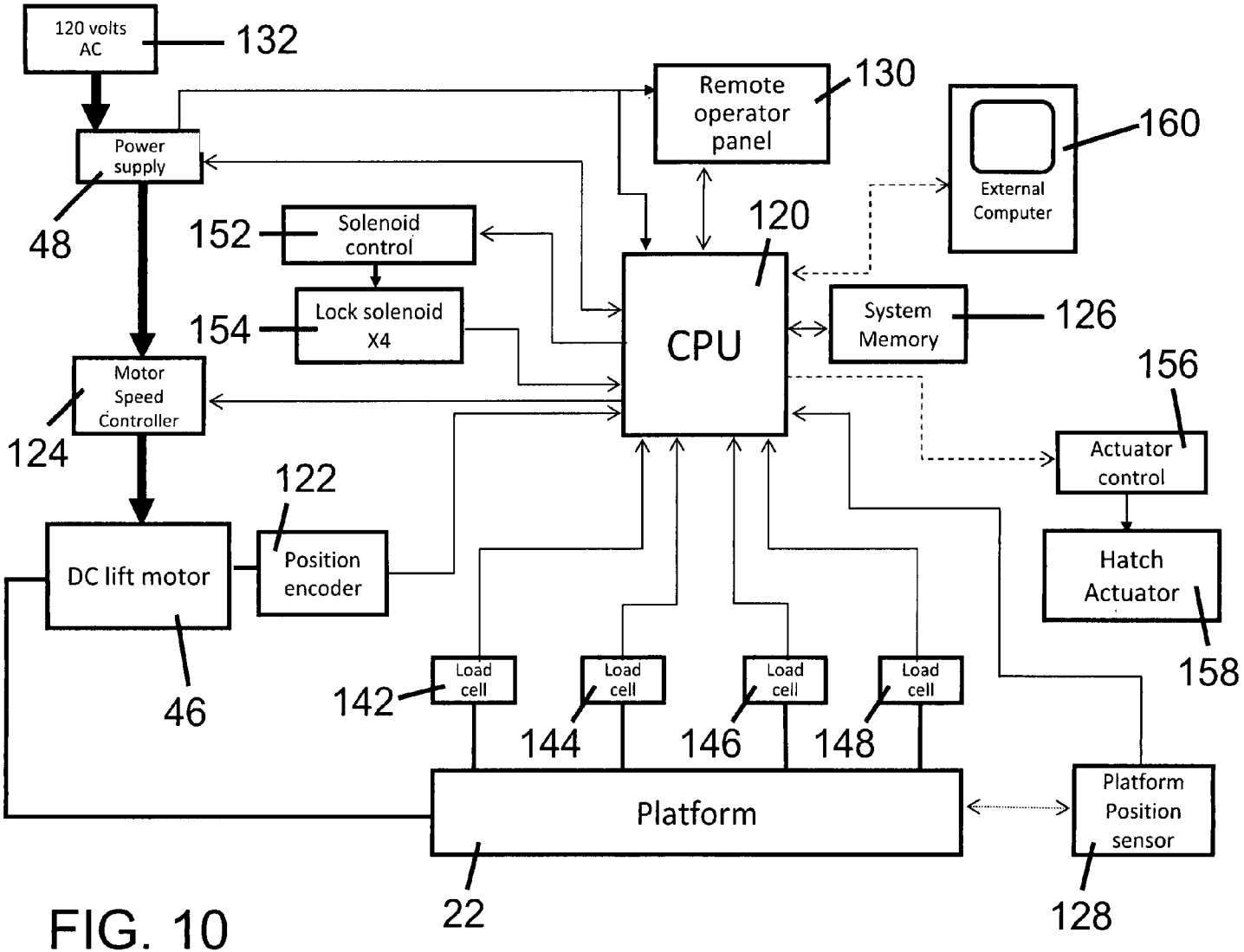
FIG. 10 is a block diagram of an exemplary control system for the platform lift system.

Turning now to FIG. 10, a block diagram of an exemplary control system for the platform lift system is illustrated. The control system includes a central processing unit (CPU) 120 that controls operation of the platform lift system in response to numerous input signals. The CPU 120 may be any conventional microprocessor or digital signal processor, such as the Propeller chip made by Parallax Inc. that is responsive to programming instructions to perform a variety of functions. A system memory 126 may be coupled to the CPU 120 to provide a location for storage of programming instructions as well as other data values used in the operation of the control system. The CPU 120 and memory 126 may be integrated onto a common chip or may be included on plural chips. It is anticipated that the CPU 120 and memory 126 be physically located on the circuit board 41 described above with respect to FIGS. 5 and 6.

The control system further includes a power supply 48, a motor speed controller 124, and a DC motor 46. The power supply 48 is coupled to a source of electrical power, such as 120 volt AC supply 132. The power supply 48 rectifies the AC voltage to supply DC power to the various electrical components of the platform lift system, including the CPU 120. The motor speed controller 124 provides a DC voltage signal to the DC motor 46. In an embodiment, the rotational speed and/or direction of the DC motor 46 corresponds to the value and/or polarity of the DC voltage signal. The CPU 120 provides control signals to each of the power supply 48 and the motor speed controller 124. The CPU 120 provides a control signal to the power supply 48 to control the value of the DC voltage signal generated by the power supply. The CPU 120 also provides a control signal to the motor speed controller 124 to control the speed of the motor 46. It should be appreciated that the CPU 120 may provide other control signals to the power supply 48 and the motor speed controller 124 to achieve other performance characteristics. The power supply 48 and motor speed controller 124 may also provide feedback signals to the CPU 120, such as relating to their operating state.

As discussed above, the motor 46 may be further coupled to a position encoder 122 that generates a periodic signal corresponding to the rotation of the motor shaft. The position encoder 122 provides the encoder signal to the CPU 120, from which the CPU 120 may derive various types of information. First, the CPU 120 may derive an instantaneous motor speed measurement from the encoder signal that can provide feedback to enable precise control over the motor speed. Using the instantaneous speed measurement, the CPU 120 would adjust the control signals provided to the motor speed controller 124 in a closed loop control system to maintain substantially constant speed with changes in load. Second, the CPU 120 may derive a position value from the encoder signal. In particular, the CPU 120 may keep track of the current position of the platform as it traverses from the stowed position to the full extent of its travel. For example, by counting the pulses generated by the position encoder 122, and calibrating the number of pulses against a predetermined measure of platform travel distance per pulse, an accurate measure of the position of the platform can be derived. This position information could be used for various purposes, such as to define or limit the maximum travel distance (i.e., floor) for the platform.

A remote operator panel 130 may also be coupled to the CPU 120. The remote operator panel 130 may be located at a distance from the main unit, such as mounted to an adjacent wall. The remote operator panel 130 may include one or more buttons and a visual display. The buttons permit user entry of control inputs, such as directing the platform lift system to move the platform 22 up or down. The visual display may illustrate operating status of the platform lift systems, programmed settings, warning signals, diagnostic data, help instructions and other information to the user. For example, the visual display may convey the current position of the platform along its travel and/or the weight of the platform and objects carried therein. The visual display may also provide textual status cues relating to operational status, such as "platform descending," "platform ascending," "obstacle detected," "stowing," etc. In an embodiment of the invention, the buttons of the remote operator panel 130 require continuous depression to cause the platform 22 to continue moving up or down. As soon as the operator removes pressure from one of the up or down buttons, movement of the platform 22 stops. This operation reduces the likelihood of an undesirable impact between the platform 22 and the operator or other bystanders.

The remote operator panel 130 may communicate with the CPU 120 through a wired or wireless connection as generally understood in the art. In another embodiment, programmable computing devices such as smart phones, laptops or tablet computers could also be programmed to serve as a remote operator panel 130. It should also be appreciated that multiple remote operator panels 130 could be connected to the CPU 120 in order to enable control from multiple locations, such as a first panel located at an upper level and a second panel located at a lower level of a structure served by the platform lift system.

The CPU 120 controls movement of the platform 22 by controlling the speed and direction of the motor 46. As described above, the motor 46 is mechanically coupled to the platform 22 through the lift cables. The CPU 120 provides a control signal to the motor speed controller 124, which is a control circuit that receives a command from the CPU and provides an electrical signal to the motor 46. In a preferred embodiment, the motor 46 is a DC motor and the electrical signal from the motor speed controller 124 is a DC signal having a voltage and sign corresponding to the desired speed and direction of the motor. In turn, the motor speed controller 124 is coupled to a power supply 48 that rectifies AC line voltage into the DC level suitable for driving the motor 46. A position encoder 122 physically coupled to the motor 46 (either directly or through other components of the drive mechanism) provides a signal to the CPU 120. The CPU 120 may process the signal from the position encoder 122 to derive a position value relating to the vertical position of the platform 22 and/or a velocity value relating to the speed that the platform 22 is moving up or down.

The platform 22 is represented schematically on FIG. 10 as a box to which four load cells 142, 144, 146, and 148 are coupled. The load cells represent the load sensors 74, 104 described above. Each of the four load cells 142, 144, 146, 148 provides a respective electrical signal input to the CPU 120 that correspond to the magnitude of load carried by the platform 22. It should be understood that the load cells are mechanically connected to the platform 22 through the cables 30 that are physically connected to the platform 22 as described above.

When weight in the platform 22 is evenly distributed, the electrical signals from each of the four load cells 142, 144, 146, 148 may be substantially uniform. But, when the weight is not evenly distributed, or during other events in which the platform is moving or comes into contact with an obstacle or becomes unbalanced, the signals produced by the load cells may vary relative to each other. In an embodiment of the invention, the load cells 142, 144, 146, 148 produce analog signals that are digitized by suitable circuitry in a manner that is well understood in the art. The programming of the CPU 120 may perform additional processing and/or filtering of the load cell signals as necessary to achieved desired performance and sensitivity to load changes. For example, the four load cell signals may be additively combined to generate a single signal representing total load on the platform 22. Alternatively, the load cell signals may be applied to a moving average, or may be subtracted from each other to derive differential signals corresponding to the differences in load from one load cell to the next. By calibrating the load cell signals to known weights, the CPU 120 can derive an accurate an instantaneous measurement of the weight in the platform 22, and can detect abrupt changes in load that can result from impacts between the platform and another object.

There are many operating conditions in which a change in load may be detected. If the load measurement from one or more of the load cells abruptly increases while the platform 22 is being raised, that might indicate that an impact between the platform 22 and an object has occurred, referred to as an up obstacle. Conversely, if the load measurement from one or more of the load cells abruptly decreases while the platform 22 is being lowered, that might also indicate that an impact between the platform 22 and an object has occurred, referred to as a down obstacle. An up obstacle and a down obstacle may manifest as a differential change in load, such as where one or more of the load cells experience greater change in load than the other load cells. For example, if the platform 22 impacts an up obstacle located on one side of the platform, the load cells on that side may experience substantially greater change in load than the load cells on the other side of the platform 22. The CPU 120 may use this difference in load signals to interpret the event as an up obstacle localized on one side of the platform 22. Likewise, the same process could be used in reverse to interpret an event as a down obstacle localized on one side of the platform 22.

The CPU 120 may be further programmed to take certain corrective actions in the case that an up obstacle or a down obstacle is detected. For example, upon detection of an up obstacle, the CPU 120 may command the motor 46 to stop and reverse direction, i.e., providing an auto-reverse function upon detection of an up obstacle. This would enable the obstructing object to be cleared out of the path of the platform 22. The same type of auto-reverse function can be applied upon detection of a down obstacle. Alternatively, the CPU 120 may take different corrective actions when encountering an up obstacle than when encountering a down obstacle. For example, the CPU 120 may command the motor 46 to auto-reverse upon detection of an up obstacle, and may command the motor 46 to stop altogether upon detection of a down obstacle. Further, the CPU 120 may dynamically determine the type of corrective action to take based on other factors, such as the magnitude or location of the detected obstacle.

If the load signals from all the load cells change in the same direction, e.g., increase, even if by differing magnitudes, the CPU 120 may interpret that as a change in weight in the platform 22. For example, when the platform 120 is in a deployed position, i.e., non-stowed, and the operator adds an object to the platform 22, all the load cells may report a proportional increase in load. Conversely, if the operator removes an object from the platform 22, all the load cells may report a proportional decrease in load. By calibrating the load signals, the CPU 120 can determine the instantaneous weight of the platform 22 and any objects carried therein. In an embodiment, the maximum weight carried by the platform 22 could be a programmable limit variable accessible by the CPU 120. If the weight placed in the platform 22 exceeds the maximum weight variable, the CPU 120 could inhibit use of the platform lift system and/or provide an audible or visual warning to the operator.

In another example, if the load signals from some load cells differ from load signals from other load cells, the CPU 120 may interpret that as an unbalanced load condition in the platform 22. By weighting the load signals from each of the load cells, the CPU 120 can roughly estimate the position of the center of mass within the platform 22. In one embodiment, the CPU 120 may apply a threshold level for the allowable unbalance of the load in the platform 22. As long as the detected magnitude of unbalance is below the threshold level, the platform lift system may continue to operate normally. But if the detected magnitude of unbalance meets or exceeds the threshold level, the CPU 120 may take corrective action, such as to inhibit operation of the motor 26 or issue a warning to the user. Additionally, or alternatively, the CPU 120 may provide a message to the user on the display of the operator panel 130 to "Rebalance Load" or provide other suitable text or symbols. After the load has been properly balanced by the user by repositioning it within the platform 22, the CPU 120 could provide a second message to the user informing that "Load is Balanced" or provide other suitable text or symbols. The CPU 120 may also interpret the load cell signals to detect dynamic conditions such as swaying of the platform 22 in which the load signals exhibit a time varying oscillation.

In another embodiment of the invention, the CPU 120 keeps a running total of accumulated weight that has been moved from one level to another, such as into an attic storage space, over the operational life of the platform lift apparatus. Because of the ease in moving cargo loads using the platform lift apparatus, the user could potentially overload a residential or commercial structure. The CPU 120 could be pre-programmed with a maximum total weight value for the structure as determined by an architect, structural engineer or building inspectors. If the total accumulated weight moved upward into the attic storage space using the platform 22 reaches the pre-programmed maximum value, the CPU 120 could inhibit further operation. The CPU 120 may also provide a suitable message to the user informing that "Maximum Storage Load is Reached" or provide other suitable text or symbols.

A solenoid control 152 and a lock solenoid 154 are also shown in FIG. 10. The lock solenoid 154 corresponds to the solenoid 92 described above with respect to FIGS. 7 and 8, and serves to lock the platform 22 in the stowed position. It should be appreciated that there may be plural lock solenoids 154. The CPU 120 provides control signals to the solenoid control 152, which in turn causes the lock solenoid 154 to extend or retract the locking arm that extends below the raised platform 22 as discussed above. The CPU 120 may also receive a feedback signal from the lock solenoid 154 that indicates the status of the solenoid, i.e., whether it is extended or retracted.

In an embodiment of the invention, the platform 22 is stowed while resting on top of the locking arms of a pair of lock solenoids 154. Upon receipt of a user command to cause the platform 22 to descend, the CPU 120 first drives the motor 26 to lift the platform 22 up and off of the locking arms. Next, the CPU 120 commands the lock solenoid 154 to retract the locking arms so that they are clear of the path of the platform 22. Then, the CPU 120 drives the motor 26 to rotate in an opposite direction, causing the platform 22 to descend past the lock solenoids 154 and passing out of nested engagement within the main unit 20.

When the platform is returned to the stowed position, the aforementioned process is reversed. Upon receipt of a user command to cause the platform 22 to ascend, the CPU 120 drives the motor 26 to rotate in the first direction to lift the platform 22 to the top of its travel so that it is above the locking arms. Next, the CPU 120 commands the lock solenoid 154 to extend the locking arms so that they are in the path of the platform 22. Then, the CPU 120 drives the motor 26 to rotate in the second direction, causing the platform 22 to descend toward and come to rest upon the locking arms of the lock solenoids 154.

The control system may also include a tray position sensor 128 that is connected to the CPU 120. The tray position sensor 128 corresponds to the position sensor 62 described above with respect to FIG. 6. The position sensor 128 provides a signal to the CPU 120 indicating that the platform 22 is in close proximity to the position sensor 128. As discussed above, the signal from the position sensor 128 may indicate to the CPU 120 that the platform has reached the uppermost point of travel. In an embodiment, the position sensor 128 may be used to indicate the point at which the motor 26 should reverse direction during a stowing operation. In another embodiment, the position sensor 128 may be physically located beyond the desired range of operation of the platform 22, and would provide a failsafe signal in case the platform 22 erroneously travels upward too far. It should be appreciated that there may be plural position sensors disposed at vertically diverse locations in order to provide additional information to the CPU 120 with respect to the vertical travel of the platform 22. The CPU 120 may also use the signal from the position sensor 128 to periodically recalibrate the position of the platform 22 instead of or in conjunction with the data provided by the position encoder 122.

As further shown in FIG. 10, an external computer 160 may be connected to the CPU 120. There are numerous commercially available forms of serial and/or parallel interfaces suitable to permit the computer 160 to communicate with the CPU 120, including but not limited to Ethernet, FireWire, and USB. The connection between the computer 160 and the CPU 120 may also be wired or wireless, and may also pass through one or more intervening networks. It is anticipated that the external computer 160 only be connected to the CPU 120 for discrete periods of time, such as to perform calibration and maintenance of the control system. For example, the external computer 160 may be used for calibration purposes to set various parameters used by the CPU 120 in controlling aspects of operation of the platform lift system, such as the maximum load capacity of the platform 22, the sensitivity of the load sensors, the maximum deployable distance or floor for the platform, the speed of the motor 26, enabling/disabling auto-reverse operation upon detection of an obstacle, and the like. Further, the external computer 160 may also be used to monitor operation of the control system and display various real-time parameters, such as the motor speed, vertical position, sensed load at each load sensor, combined load (or weight) in the platform, motor brake status, total operating time, total number of up/down cycles, time since last maintenance, and the like. The external computer 160 may also be used to modify, replace or update the software instructions stored in the memory 126 and accessed by the CPU 120.

It should be appreciated that the remote operator panel 130 may also be used to perform certain calibration and maintenance functions instead of an external computer 160. For example, the remote operator panel 130 may include certain maintenance settings to permit selection and modification of any of the aforementioned parameters used by the CPU 120. The remote operator panel may also include a lock to prevent unauthorized use of the platform lift system. The lock may comprise a physical lock with a key that is removable by the user. The control system may be adapted to permit movement of the platform only when the key is inserted and turned to an "on" position. Alternatively, the lock may comprise a software lock that restricts operation only to users that enter a pre-programmed password.

FIG. 10 further illustrates an actuator control 156 and hatch actuator 158. In some embodiments of the present application, it may be desirable to include a hatch that covers the platform lift system. The hatch may be constructed of materials that match the adjacent flooring of the structure so it blends into the flooring when the hatch is closed and the platform lift system not in use. In such applications, the actuator 158 may be used to open and close the hatch. The actuator 158 may comprise a conventional linear actuator driven using mechanical, hydraulic, pneumatic, piezoelectric, electro-mechanical, linear motor, or other such means generally understood in the art. The actuator control 156 communicates with the CPU 120 and provides suitable control signals to the actuator 158 to cause it to open or close the hatch. It may also be desirable to employ a hatch or door mounted such that it functions to selectively close the ceiling opening below the platform 22. For example, in a multi-story application, one hatch located level with a floor and another located approximately level with the ceiling below may be concurrently controlled by the CPU 120 to be opened such that the platform can pass through that level of the structure to access a lower floor level. Similarly, in an application in which the platform 22 travels within a closed shaft, additional sensors, such as a microswitch, may be employed to detect if an access door to the shaft is opened, in which case the CPU may inhibit motion of the platform 22. The CPU 120 could also drive an actuator that locks to prevent an access door from being opened when the platform 22 is in other than a predetermined position.

In an embodiment of the invention, the user would be able to command the operation of the actuator control 156 via the remote operator panel 130. For example, the user could command the opening or closing of a hatch by pushing suitable buttons of the remote operator panel 130. In other embodiments of the invention, the control system may automatically control the opening or closing of the hatch in response to operational conditions of the platform lift system. For example, the CPU 120 may command the hatch to automatically close upon the detection of various conditions, such as if the platform lift system has not been used in a predetermined period of time, or if the platform 22 has been selectively moved downward and away from the main unit by a predetermined distance (e.g., as determined from a count of the pulses from the position encoder 122). These operations would serve to prevent persons or objects from inadvertently falling through the opening in the platform lift system in times when the platform 22 is in other than the stowed position. Conversely, the CPU 120 may command the hatch to automatically open upon detection that the platform 22 is moving upward and approaching the main unit.

Having thus described a preferred embodiment of a platform lift system, it should be apparent to those skilled in the art that certain advantages have been achieved. It should also be appreciated that various modifications, adaptations, and alternative embodiments thereof may be made within the scope and spirit of the present invention.

What is claimed is:

1. A platform lift apparatus, comprising;

a main body having a platform receiving portion and a utility portion;

a drive train substantially contained within the utility portion of the main body, the drive train comprising a rotatable shaft having plural lift drums and a motor operatively coupled to the shaft to cause selective rotation thereof, each of the lift drums having an associated lift tether coupled thereto and wound thereon;

a platform coupled to respective ends of the lift tethers to suspend the platform from the platform receiving portion of the main body, the platform being selectively movable by operation of the drive train to travel vertically relative to the main body, the platform being substantially nested within the platform receiving portion of the main body when at an uppermost point of travel;

at least a first sensor operatively coupled to a first one of the lift tethers and a second sensor operatively coupled to a second one of the lift tethers, the first sensor providing a first signal corresponding to slack on the first one of the lift tethers and the second sensor providing a second signal corresponding to slack on the second one of the lift tethers; and a control circuit operatively coupled to the motor and the first and second sensors, wherein the control circuit takes at least one corrective action if the first and second signals indicate slack on at least one of the first and second ones of the lift tethers;

wherein the control circuit causes the platform to travel upward by driving the motor to rotate the shaft in a first direction to wind the lift tethers onto the respective lift drums and causes the platform to travel downward by driving the motor to rotate the shaft in a second direction to unwind the lift tethers from the respective lift drums.

2. The platform lift apparatus of claim 1, wherein the control circuit is further configured to take said at least one corrective action only when said platform is traveling downward.

3. The platform lift apparatus of claim 1, further comprising at least one load sensor operatively coupled to the control circuit, the at least one load sensor providing a first electrical signal to the control circuit indicative of a load on the platform, wherein the control circuit is configured to take at least one other corrective action if said first electrical signal indicates that said load on the platform has exceeded a maximum load value.

4. The platform lift apparatus of claim 3, wherein the control circuit is further configured to take said at least one other corrective action only when said platform is traveling upward.

5. The platform list apparatus of claim 1, further comprising a position sensor coupled to the platform receiving portion of the main body, wherein said position sensor is configured to provide a position signal to the control circuit when the platform has reached an uppermost position.

6. The platform lift apparatus of claim 5, wherein said position sensor comprises a Hall-effect sensor.

7. The platform lift apparatus of claim 1, wherein the control circuit is further configured to receive a second electrical signal having a plurality of pulse widths, wherein each pulse width corresponds to a predetermined distance of vertical movement of the platform, and to count the plurality of pulse widths to determine a vertical position of the platform.

8. The platform lift apparatus of claim 7, wherein the control circuit is configured to determine the vertical position of the platform by zeroing out a counter when the platform is in an uppermost position and counting the plurality of pulse widths in the second electrical signal to determine a vertical position with respect to the uppermost position.

9. The platform lift apparatus of claim 8, wherein the control circuit is further configured to store a lowermost position during initialization, and to take at least one other action when the platform approaches the lowermost position.

10. A method of moving a platform in relation to a main body having a platform receiving portion and a utility portion, comprising;

driving a motor in a first direction to wind a plurality of tethers around a plurality of drums, causing the platform to travel in an upward direction;

driving said motor in a second direction to unwind the plurality of tethers from the plurality of drums, causing the platform to travel in a downward direction;

receiving by a control circuit a first signal from a first one of a plurality of sensors at least when said platform is traveling in said downward direction, said first one of said plurality of sensors being coupled to a first one of said plurality of lift tethers, said first one of said plurality of lift tethers being used to suspend a first portion of said platform from said main body;

receiving by said control circuit a second signal from a second one of said plurality of sensors at least when said platform is traveling in said downward direction, said second one of said plurality of sensors being coupled to a second one of said plurality of lift tethers, said second one of said plurality of lift tethers being used to suspend a second portion of said platform from said main body;

receiving by said control circuit a load signal from a load sensor at least when said platform is traveling in said upward direction;

using by said control circuit said load signal to determine a load on said platform at least when said platform is traveling in an upward direction;

using by said control circuit said first and second signals to determine, respectively, whether there is slack in said first and second ones of said plurality of tethers when said platform is traveling in a downward direction;

performing at least one corrective action if said load is greater than a maximum load value; and performing at least one other corrective action if it is determined that there is slack in at least one of said first and second ones of said plurality of lift tethers.

11. The method of claim 10, wherein said step of performing at least one corrective action if said load is greater than a maximum load value comprises at least one of stopping said motor from being driven in said first direction and driving said motor in said second direction.

12. The method of claim 10, wherein said step of performing at least one other corrective action if it is determined that there is slack in at least one of said first and second ones of said plurality of lift tethers further comprises at least one of stopping said motor from being driven in said second direction and driving said motor in said first direction.

13. The method of claim 10, further comprising the step of receiving by said control circuit a position signal from a position sensor to determine when said platform has reached an uppermost position.

14. The method of claim 10, further comprising the step of receiving by said control circuit a signal indicative of vertical movement and using said signal to determine a vertical position of said platform.

15. The method of claim 14, further comprising the steps of using a position signal to identify an uppermost position of said platform, storing a lowermost position of said platform in memory, using said signal indicative of vertical movement to identify a position of said platform with respect to said uppermost position, and performing at least one action immediately before said position of said platform reaches said lowermost position.

16. The method of claim 14, wherein said step of performing at least one action immediately before said position of said platform reaches said lowermost position comprises slowing said motor as said platform approaches said lowermost position.

17. A platform lift apparatus, comprising;

a main body having at least a platform receiving portion;

at least one motor configured to move a platform vertically with respect to said main body by winding and unwinding a plurality of lift tethers;

said platform coupled to respective ends of the plurality of lift tethers to suspend said platform from said platform receiving portion of said main body;

at least a first sensor operatively coupled to a first one of the plurality of lift tethers and a second sensor operatively coupled to a second one of the plurality of lift tethers, the first sensor providing a first signal corresponding to slack on the first one of the plurality of lift tethers and the second sensor providing a second signal corresponding to slack on the second one of the plurality of lift tethers; and a control circuit operatively coupled to the motor and the first and second sensors, wherein the control circuit takes at least one corrective action if (i) the first and second signals indicate slack on at least one of the first and second ones of the plurality of lift tethers and (ii) said platform is traveling in a downward direction;

wherein said control circuit causes said platform to travel upward by driving said at least one motor to rotate in a first direction to wind said plurality of lift tethers onto respective receiving devices and causes said platform to travel downward by driving said at least one motor to rotate in a second direction to unwind said plurality of lift tethers from said respective receiving devices.

18. The platform lift apparatus of claim 17, further comprising at least one load sensor operatively coupled to the control circuit, the at least one load sensor providing an electrical signal to the control circuit indicative of a load on the platform, wherein the control circuit is configured to take at least one other corrective action if (i) said electrical signal indicates that said load has exceeded a maximum load, and (ii) said platform is traveling upward.

19. The platform lift apparatus of claim 17, further comprising a position sensor coupled to the platform receiving portion of the main body, wherein said position sensor is configured to provide a position signal to the control circuit when the platform has reached an uppermost position.

20. The platform lift apparatus of claim 19, further comprising a movement sensor configured to provide a movement signal to the control circuit, the control circuit using said position signal, said movement signal, and a predetermined lowermost position to take at least one action when said platform approaches said lowermost position.

* * * * *